US007530960B2

(12) United States Patent
Cook

(10) Patent No.: US 7,530,960 B2
(45) Date of Patent: May 12, 2009

(54) THERAPEUTIC VIBRATION APPARATUS

(76) Inventor: Gerry Cook, 3115 N. Boyer Ave., Sandpoint, ID (US) 83864

( * ) Notice: Subject to any disclaimer, the term of this patent is extended or adjusted under 35 U.S.C. 154(b) by 251 days.

(21) Appl. No.: 10/586,042

(22) PCT Filed: Jan. 13, 2005

(86) PCT No.: PCT/US2005/001792

§ 371 (c)(1),
(2), (4) Date: Jul. 12, 2006

(87) PCT Pub. No.: WO2005/067860

PCT Pub. Date: Jul. 28, 2005

(65) Prior Publication Data

US 2008/0132812 A1 Jun. 5, 2008

(51) Int. Cl.
*A61G 1/00* (2006.01)

(52) U.S. Cl. ..... 601/46; 601/49; 601/90

(58) Field of Classification Search ..... 601/23, 601/46, 49, 51, 90
See application file for complete search history.

(56) References Cited

U.S. PATENT DOCUMENTS 3,742,941 A 7/1973 Aizenstat
5,273,028 A * 12/1993 McLeod et al. ..... 601/35
5,484,388 A * 1/1996 Bassett et al. ..... 601/27
5,716,331 A 2/1998 Chang
5,772,615 A 6/1998 Elder et al.
6,234,975 B1 * 5/2001 McLeod et al. ..... 600/552
6,468,236 B1 10/2002 Sumanac
6,561,991 B2 * 5/2003 McLeod et al. ..... 600/587
6,620,117 B1 * 9/2003 Johnson et al. ..... 601/90
2004/0068211 A1 4/2004 Leivseth et al.
2004/0210173 A1 10/2004 Swidler

* cited by examiner

*Primary Examiner*—Michael A. Brown
(74) *Attorney, Agent, or Firm*—Richard C. Conover

(57) ABSTRACT

A therapeutic vibration apparatus includes a motor operated vibrator mounted beneath a vibration platform. The motor drives a drive shaft on which a fixed weight is eccentrically mounted. Further, a rotatable weight is eccentrically mounted to the drive shaft. The fixed weight includes a stop protruding outwardly and the rotatable weight is positioned on the drive shaft at a location to be caught by the stop when the shaft is rotating. A controller is used to change the direction of rotation of the motor so that when the drive shaft is rotated in one direction, the rotatable weight is caught by the stop on a side aligned with the eccentric portion of the fixed weight and when the motor is reversed in direction the weight is caught on the other side of the drive shaft in opposition to the eccentric portion of the fixed weight.

5 Claims, 5 Drawing Sheets

THERAPEUTIC VIBRATION APPARATUS

BACKGROUND OF THE INVENTION

The present invention relates to a therapeutic vibration apparatus which includes a vibration platform on which a user stands, sits or lies.

It is well known that vibratory stimulation benefits a user in several different ways including increasing strength; increasing bone density; increasing flexibility; and increasing blood circulation. Further, the user may also experience suppression of pain, increased lymph drainage, suppression of cellulite and enhance the mental well being.

Devices for vibratory stimulation of the human body are known such as described in United States Patent Application Publication No. US 2004/0068211.

The prior art devices known do not have the capability of easily changing the vibration amplitude on The prior art devices known do not have the capability of easily changing the vibration amplitude on the vibration of the vibration platform. The present invention provides an improved device which enables a user to select a vibration amplitude appropriate for the use.

SUMMARY OF INVENTION

The present invention relates to a therapeutic vibration apparatus including a motor operated vibrator mounted beneath a vibration platform on which a user stands, sits or lies. The motor drives a drive shaft on which a fixed weight is eccentrically mounted. Further, a rotatable weight is eccentrically mounted to the drive shaft in rotatable relation thereto. The fixed weight includes a stop protruding outwardly from the fixed weight adjacent to the drive shaft and extends in a direction parallel with the longitudinal axis of the drive shaft. The rotatable weight is positioned on the drive shaft at a position to be caught by the stop when the shaft is rotating. A controller is also provided for changing the direction of rotation of the motor so that when the drive shaft is rotated in one direction the rotatable weight is caught by the stop on a side aligned with the eccentric portion of the fixed weight and when the motor is reversed in direction the weight is caught on the other side of the drive shaft in opposition to the eccentric portion of the fixed weight. Thus, the amplitude of vibration can be increased or decreased simply by changing the direction of rotation of the motor.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
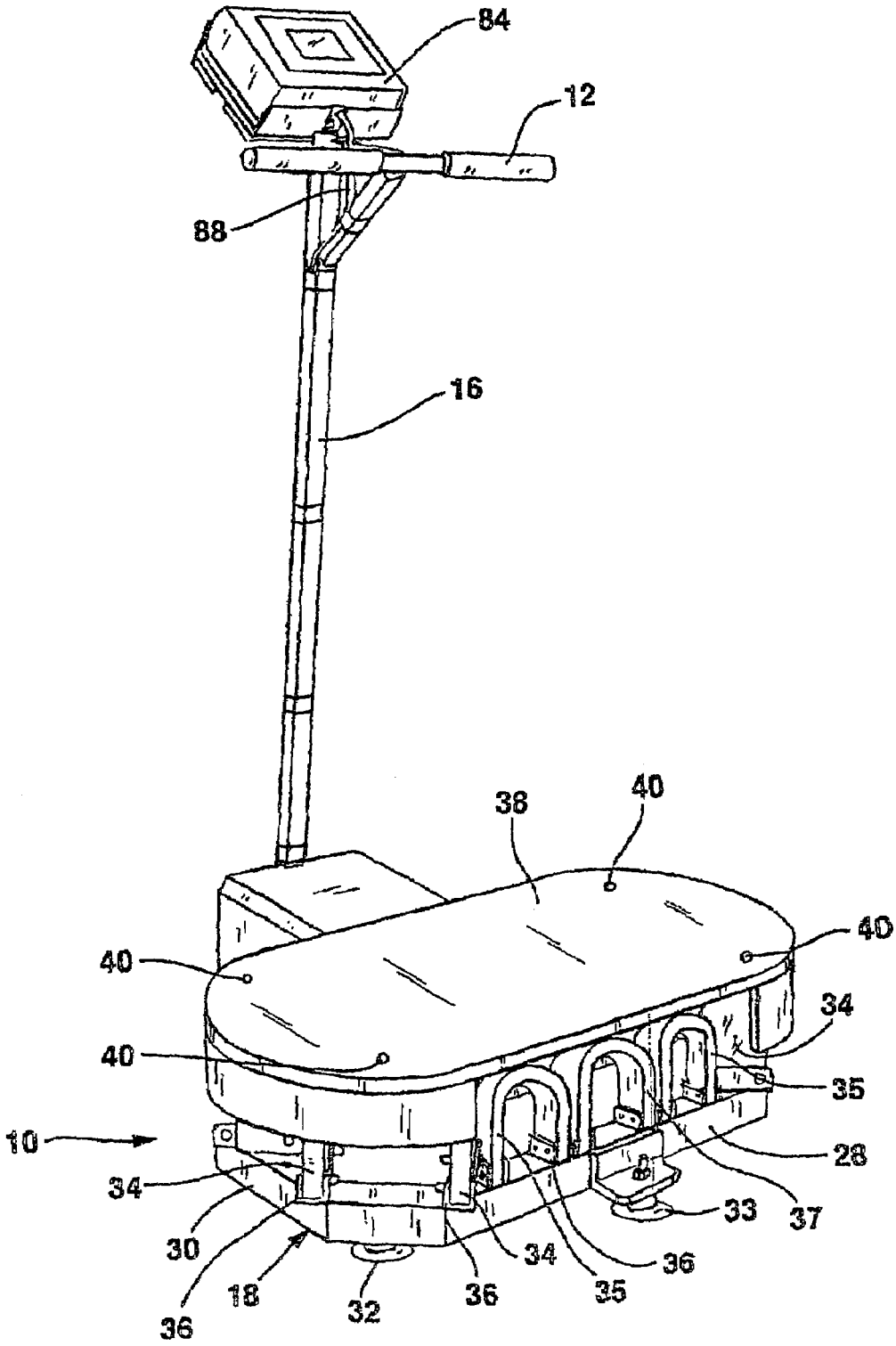
FIG. 1 is a front perspective view of a therapeutic vibration apparatus according to the present invention.
Figure 2:
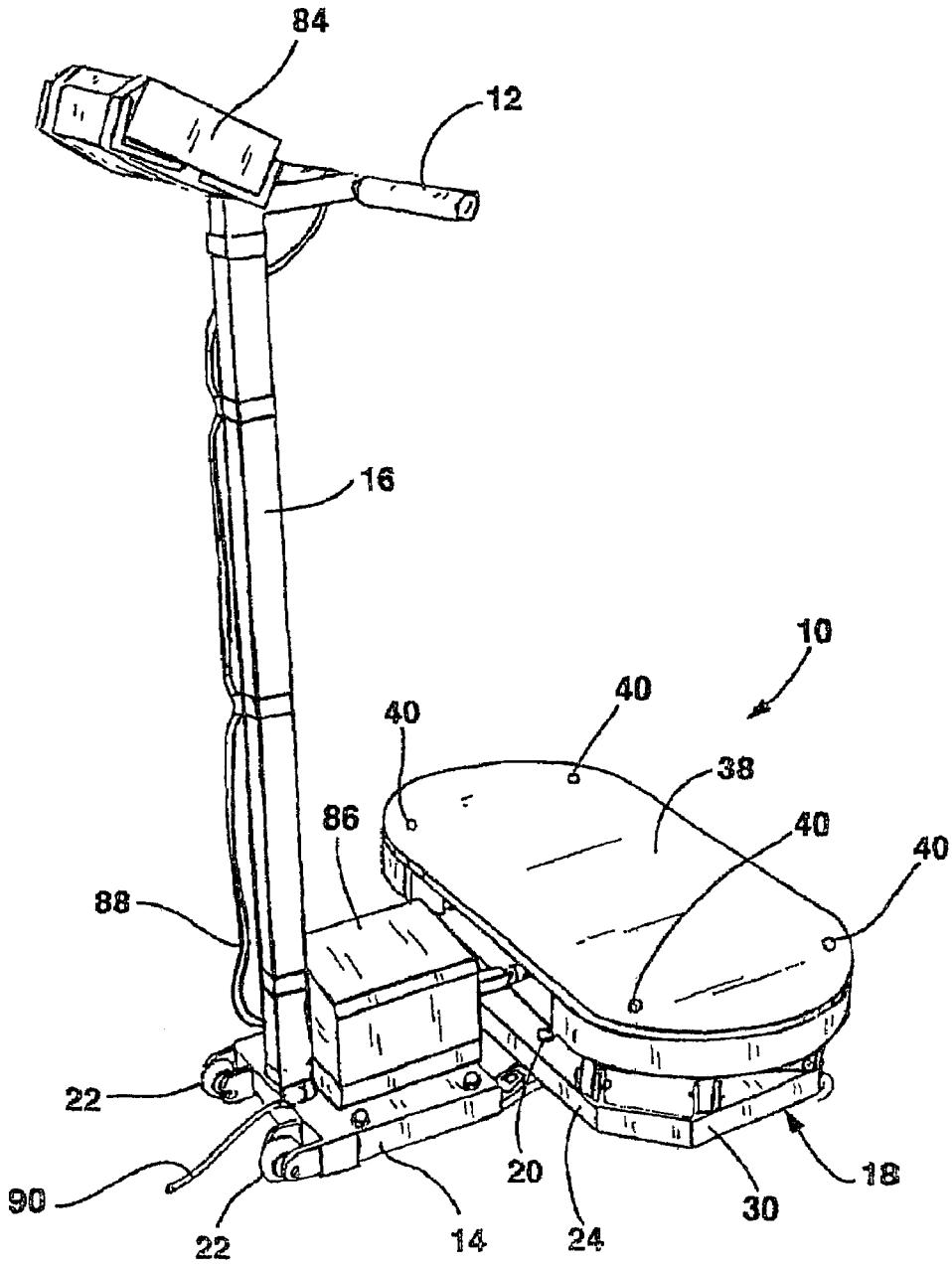
FIG. 2 is a left side perspective view of the invention shown in FIG. 1.

A therapeutic vibration apparatus 10 according to the present invention is shown in FIG. 1. The apparatus 10 includes a handle bar 12 which is attached to a "U" shaped support frame 14 with an upright support standard 16 as shown in FIG. 2. The distal ends of the "U" shaped support frame 14 are attached to a base frame 18 with bolts 20 as shown in FIG. 2. The "U" shaped frame 14 is provided with a pair of rollers 22 so that when the upright support standard 16 is tilted the vibration apparatus 10 can be easily moved to a different location.

Figure 3:
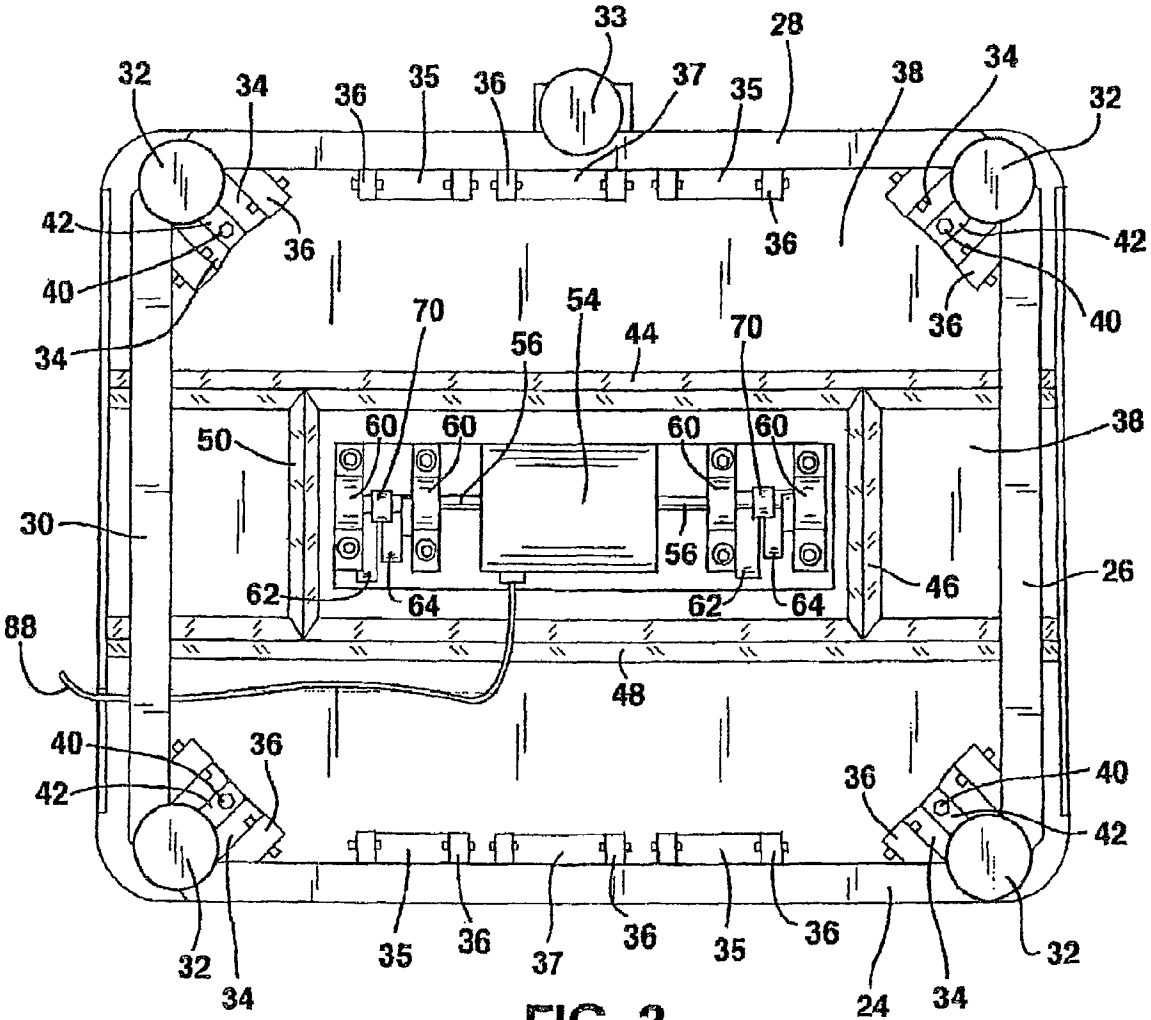
FIG. 3 is a bottom view of the invention as shown in FIG. 1 with portions removed.

As shown in FIG. 3, the base frame 18 is a rectangular frame having four frame members 24, 26, 28 and 30. A non-skid support 32 is mounted at each of the four corners of frame 18 as shown in FIG. 3. In addition, an adjustable height non-skid support 33 is mounted to frame member 28 as shown in FIG. 1.

Figure 4:
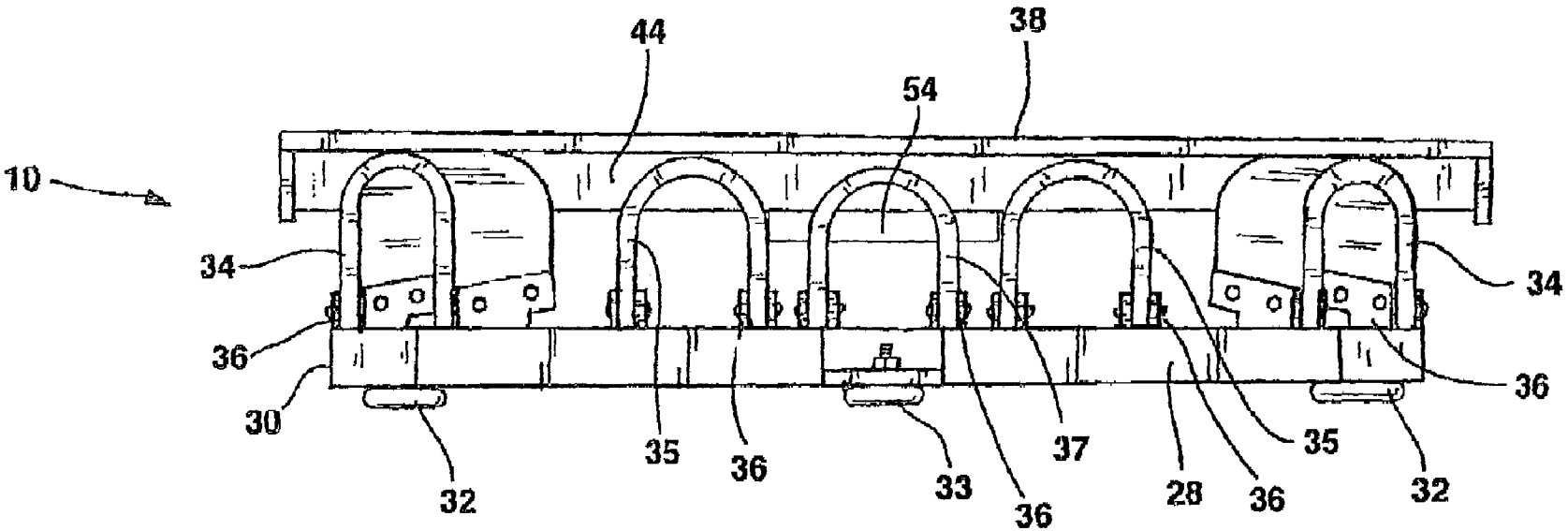
FIG. 4 is a rear elevational view of the invention shown in FIG. 1 with portions removed.

A series of resilient supports are mounted to the base frame 18 as shown in FIGS. 3 and 4. Four resilient supports 34 are provided with one resilient support 34 located at each corner of the base frame 18. An additional two intermediate resilient supports 35 are located on each of the base frame members 24 and 28. Further a central resilient support 37 is located between the respective two intermediate resilient supports 35 on the base frame members 24 and 28.

In a preferred embodiment, the resilient supports 34, 35 and 37 are constructed of a rectangular sheet of rubber material which has been bent into an arch configuration. Each free end of the resilient supports 34, 35 and 37 are mounted to the frame 18 with a channel bracket 36.

A vibration platform 38 rests on top of the resilient supports 34 as shown in FIG. 4. The vibration platform is secured to the base frame 18 with bolts 40 which extend through the vibration platform 38 and then through a respective resilient support 34 located at each corner of the base frame 18 as shown in FIG. 3. A rectangular washer 42 is provided on the underside of the resilient support 34 to prevent slippage of the bolt 40 through the resilient support.

In a preferred embodiment, the resilient supports 34 have a height greater than resilient supports 35 and 37. The resilient supports 37 have the least height and the intermediate resilient supports 35 have a height between the height of resilient supports 34 and resilient supports 37. The reason for the varying heights is that corner supports will support a person or a person lifting weights up to about 450 pounds. When the weight is greater than this, the vibration platform will be pushed downwardly against the resilient supports 34 to rest on top of resilient supports 35. The resilient supports 34 and 35 will support weight up to about 850 pounds. With a greater weight the vibration platform 38 will be pushed further downwardly until it rests on resilient supports 37. With this arrangement, the vibration platform 38 will accommodate different weights without the necessity of providing a single resilient support to accommodate the maximum weights. Thus, vibration platform 38 has less stiffness with lower weights than with heavier weights positioned on the vibration platform 38.

In a preferred embodiment, a set of four angle iron members 44, 46, 48 and 50 are mounted to the underside of platform 38 as by welding to provide rigidity to the vibration platform 38. A mounting plate 52 is also welded to the underside of the vibration platform 38.

As shown in FIG. 3, a motor driven vibrator is used for vibrating the vibration platform 38. This vibrator includes a conventional, three phase, reversible dual-shaft motor 54. The motor 54 is provided with a pair of drive shafts 56 extending out either side of motor 50 as shown in FIG. 3. The distal ends of the drive shafts 56 are mounted in spaced apart pillow block bearings 58 and 60 which are mounted to the mounting plate 52 with bolts.

An eccentrically-mounted fixed weight 62 and an eccentrically-mounted rotatable weight 64 are mounted to each shaft 56 between the two pillow block bearings 58 and 60.

Figure 5:
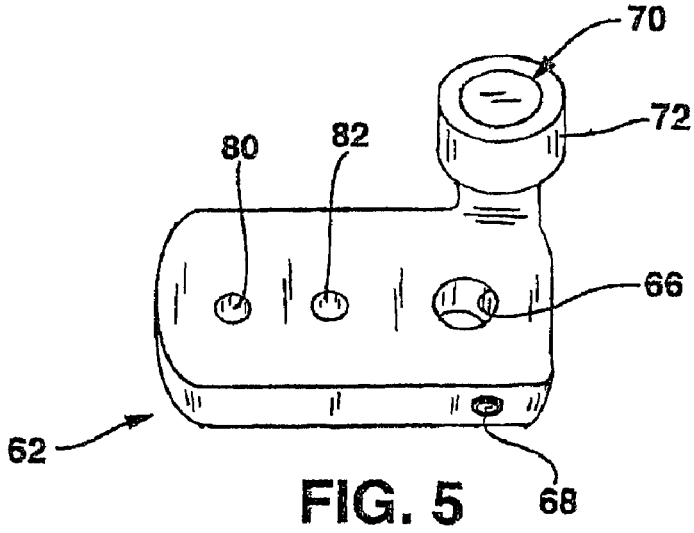
FIG. 5 is a perspective view of a fixed weight used with the present invention.
Figure 6:
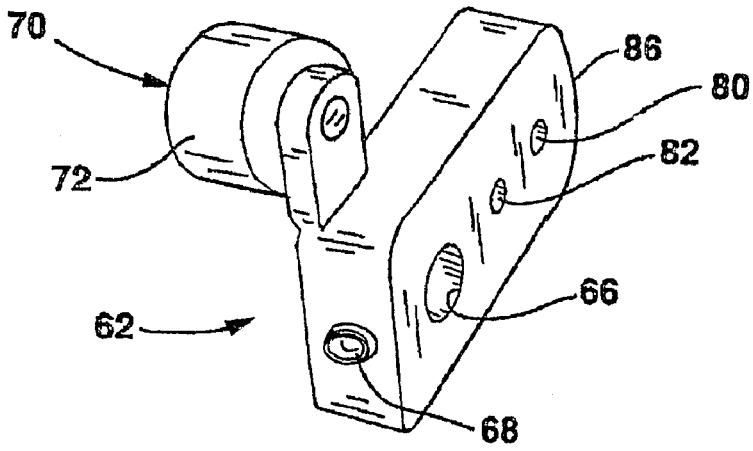
FIG. 6 is a right side perspective view of the fixed weight shown in FIG. 5.

The fixed weight 62 is shown in FIG. 5. This weight 62 includes an off-center bore 66 for receiving the shaft 56. A pair of threaded bores 68 are provided in adjacent edges of the first weight 62 as shown in FIGS. 5 and 6. The bores 68 extend through the fixed weight 62 and into the bore 66. The threaded bores 68 receive set screws (not shown) for securing the fixed weight 62 to the drive shaft 56.

A stop 70 is secured to one face of the first weight 62 adjacent the bore 66 as shown in FIGS. 5 and 6 and extends outwardly in a perpendicular relation to a face of the fixed weight 62 and in parallel relation with a longitudinal axis of bore 66. In a preferred embodiment, a polyethylene sleeve 72 is mounted on the stop 70.

Figure 7:
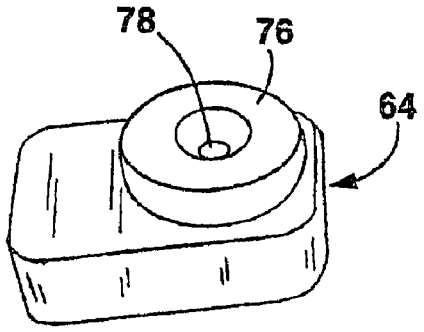
FIG. 7 is a perspective view of a rotatable weight used with the present invention.
Figure 8:
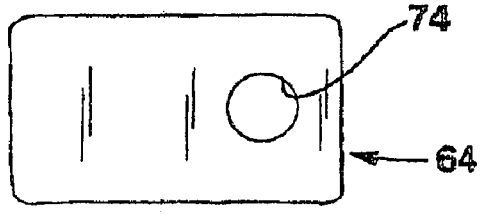
FIG. 8 is a rear view of the rotatable weight shown in FIG. 7.

The rotatable weight 64 is shown in FIGS. 7 and 8. This rotatable weight is provided with an off-center bore 74 for receiving the shaft 56. A spacer 76 is mounted to one side of the rotatable weight 74 and has a bore 78 axially aligned with the bore 74 as shown in FIG. 7. The bore 74 and 78 are sized to rotatably receive the shaft 56.

The fixed weights 62 and the rotatable weights 64 are sized so that when these weights revolve with the drive shafts 56, they do not strike the mounting plate 52.

With this construction, the vibration platform vibrates with each revolution of the drive shaft 56 because of the unbalanced weight provided by the fixed weights 62 and the rotatable weights 64 mounted on the drive shafts 56. When the motor 54 is energized, the fixed weight 62 will rotate with the shaft 56 and the stop 72 will catch the rotatable weight 62. Depending on the direction of rotation of the motor 54, the rotatable weight 62 will be caught by stop 72 either on the side of shaft 56 in alignment with the eccentric portion of the fixed weight 62 or on the side of shaft 56 opposite the eccentric portion of the fixed weight 62. When the fixed weight 62 and rotatable weight are aligned, the amplitude of vibration increases because of the increased weight on one side of the shaft 56. When the direction of the motor 54 is reversed and the rotatable weight 62 is on the opposite side of shaft 56, the amplitude of vibration is reduced, because the weight of the eccentric portion of fixed weight 62 is off set by the weight of the eccentric portion of the rotatable weight 64.

As will be noted, simply by reversing the direction of the motor 50, the amplitude of the vibration is either increased or decreased depending on the direction of rotation of the motor.

It is to be also noted that by increasing the mass of the fixed weight 62, the amplitude of vibration can also be varied. By increasing the mass, the amplitude of vibration is increased and by decreasing the mass, the amplitude of vibration is lessened.

In order to increase the mass of the fixed weight 62, the fixed weight 62 is provided with a series of threaded holes 80 and 82 as shown in FIGS. 5 and 6. To increase the mass of the fixed weight 62, a bolt (not shown) is threaded into one or both of the threaded holes 78 or 80. The weight of the bolts inserted increase the mass of the fixed weight 62.

A conventional controller 84 is used for controlling the speed and direction of rotation of the motor 54. In a preferred embodiment, the controller 84 is a three-phase AC adjustable speed drive, micro series inverter manufactured by Leeson. The controller 84 is electrically connected in a conventional manner to an invertor 86 and the motor 54 with conductor cable 88. The controller 84 includes an internal micro processor which allows a user to control the speed of the motor 54 as well as the direction of rotation of the motor 54. Further, the controller 84 includes a timer for setting the time during which the motor is energized. A power cord 90 connects the invertor 86 to a conventional power source.

While the fundamental novel features of the invention have been shown and described, it should be understood that various substitutions, modifications and variations may be made by those of ordinary skill in the art without departing from the spirit or scope of the invention. Accordingly, all such modifications or variations are included in the scope of the invention as defined by the following claims.

I claim:

1. A therapeutic vibration apparatus comprising:

a vibration platform having an upper surface and a bottom surface;

a reversible motor mounted to the bottom surface of the vibration platform and connected to a drive shaft having a longitudinal axis;

a fixed weight eccentrically mounted to the drive shaft and secured thereto;

a rotatable weight eccentrically mounted to the drive shaft in rotatable relation thereto;

the fixed weight further including a stop protruding outwardly from the fixed weight adjacent to the drive shaft and extending in a direction parallel with the longitudinal axis of the drive shaft;

the rotatable weight positioned on the drive shaft at a position to be caught by the stop when the drive shaft is rotating; and means for reversing the direction of rotation of the motor.

2. The therapeutic vibration apparatus according to claim 1 further including a pair of spaced apart pillow block bearings mounted to the bottom surface of the vibration platform for receiving and supporting the drive shaft and wherein the fixed weight and rotatable weight are mounted to the drive shaft between the pillow block bearings.

3. The therapeutic vibration apparatus according to claim 1 including a base frame for resting on a ground surface and a resilient support connected between the base frame and the vibration platform for resiliently supporting the vibration platform in spaced apart relation above the base frame.

4. The therapeutic vibration apparatus according to claim 3 wherein at least two resilient supports support the vibration platform and wherein at least one of the resilient supports has a height less than at least one of the other resilient supports.

5. The therapeutic vibration apparatus according to claim 1 further including means for increasing the mass of the fixed weight.

* * * * *